US005103714A

United States Patent [19]

LaFrance

[11] Patent Number: 5,103,714

[45] Date of Patent: Apr. 14, 1992

[54] RETRO-FIT GAS SYSTEM FOR CONTROLLING THE FIRING RATE OF THE COLT M16 AUTOMATIC CARBINE

[76] Inventor: Timothy F. LaFrance, 5231 Cushman Pl. #7, San Diego, Calif. 92110

[21] Appl. No.: 716,550

[22] Filed: Jun. 17, 1991

[51] Int. Cl.[5] ..... F41D 5/04

[52] U.S. Cl. ..... 89/129.01; 89/193

[58] Field of Search ..... 89/129.01, 193, 191.01

[56] References Cited

U.S. PATENT DOCUMENTS 3,203,312 8/1965 Beretta ..... 89/191.01
4,244,273 1/1981 Langendorfer et al. ..... 89/193
4,765,224 8/1988 Morris ..... 89/191.01

*Primary Examiner*—David H. Brown
*Attorney, Agent, or Firm*—Charles C. Logan, II

[57] ABSTRACT

A retro-fit gas system for controlling the firing rate of the Colt M16 automatic carbine that involves removing the original short gas tube that has a predermined length and which has a longitudinal axis extending from its front end to its rear end and replacing it with a novel twin gas tube assembly. The gas tube assembly has a first gas tube whose front portion passes through a longitudinally extending lower bore hole in a junction block. A second gas tube has its front end removably inserted in a longitudinally extending upper bore hole in the junction block. A vertically extending cross passage bore hole in the junction block connects with gas ports in the respective first and second gas tubes thereby providing an extended length of gas travel passage distance for reducing the cyclic rate of fire of the Colt M16 carbine.

9 Claims, 2 Drawing Sheets

RETRO-FIT GAS SYSTEM FOR CONTROLLING THE FIRING RATE OF THE COLT M16 AUTOMATIC CARBINE

BACKGROUND OF THE INVENTION

This invention relates to Colt M16 automatic carbines and specifically to a retro-fit gas system for controlling the firing rate.

The Colt M16 rifle has a gas operated system having a gas port located at a predetermined point on the barrel near its forward end. The port detects the accummulation of gases when a bullet has been fired. This gas pressure is fed back through a gas line to a bolt carrier mechanism which unlocks the bolt, ejects the cartridge, feeds in a new cartridge, and locks the bolt in the conventional manner that all M16's or other repeating rifles use.

The standard Colt M16 rifle has a 20 inch barrel and fires approximately 650 rounds of ammunition per minute. The shorter carbine has 10 inch to 16 inch barrels and a shorter gas tube and they fire at a much higher rate of fire. At this rate of fire, everything becomes critical and the ammunition must be up to spec, the barrel must be clean, and other conditions must be proper, or the Colt carbine jams up. When the barrel is shortened to 10, 12, or 14 inches long, the timing relationship between the pressure and the bolt carrier mechanism causes the bolt mechanism to be operated sooner and at a time when all of the pressure in the barrel has not been reduced to zero. This causes the chamber to be opened under pressure which has a tendency to hold the cartridge in place since the cartridge expands under intense pressure and some small amount of time is necessary for the cartridge to contract as the pressure reduces to 0 before the cartridge can be expelled.

Opening the breech under pressure is dangerous at best since the casing is being expelled while still in an expanded state and a tendency for jamming is very high.

These problems have been addressed in what is termed in the field as a brute force method by utilizing special lubricants to ease the ejection of the casing. These new lubricants do improve the situation, however, the problem is not completely solved because while the instance of jamming has been reduced, when a barrel has been shortened from its standard 16 inches in length to a shorter length, this reduces the timing cycle and the rate of fire in the carbine is increased to between 1300 to 1600 rounds a minute. With this increased rate of fire it is even more important that the chamber be shiny and polished and that the ammunition be up to spec. Even in the absence of the tendency to jam the rate of fire is so fast that the gun becomes almost unuseable and unwieldy. Additionally, the excess rate of fire is very wasteful of ammunition, and inaccurate at best and over a short period of time heat generated by this high rate of fire causes additional damage to the gun, again increasing the tendency to jam and at an excessive rate.

It is an object of the invention to provide a novel retro-fit gas system for controlling the firing rate of the Colt M16 automatic carbine that requires no modifications to the existing structure.

It is another object of the invention to provide a novel retro-fit gas system for controlling the firing rate of the Colt M16 automatic carbines having barrels shorter that 16 inches that will allow them to operate in the approximate range of 800 rounds per minute.

It is also an object of the invention to provide a novel retro-fit gas system for controlling the firing rate of the Colt M16 automatic carbines that is economical to manufacture and market.

It is an additional object of the invention to provide a novel retro-fit gas system for controlling the firing rate of the Colt M16 automatic carbine that is easily and quickly installed in the rifle.

SUMMARY OF THE INVENTION

The novel retro-fit gas system is designed exclusively for installation in carbine versions of a Colt M16 rifle, both semi-automatic and full automatic. It will reduce the cyclic rate of fire of these weapons in the full automode of well over 1300 rounds per minute down to 800 rounds per minute, regardless of the barrel length, be it 16 inches down to the shortest 10 inch version.

Prior to installation of the novel retro-fit gas system, the size of the gas port hole drilled in the barrel of the M-16 rifle must be determined and corrected to insure a proper gas volume for the system to operate in the full auto mode. To do this the front sight frame must be removed from the barrel and the gas port hole gauged with wire-size number drills. On a factory Colt 16 inch barrel with which the AR-15 versions of the carbine are equipped, the hole drilled at the factory is 0.077 inches. That is the minimum size hole with which the 16 inch barrel can operate correctly. Barrel lengths from 10 inches to 14 inches must have a 0.101 hole for a gas port as an absolute minimum. It is important not to exceed 0.120 inches under any circumstances, as this will cause the shaving of the bullet jacket to such an extent that the copper shavings will plug the gas system in only 5000 rounds. In the next step prior to installation of the novel retro-fit gas system, the barrel nut must be secured to the upper receiver tightly and in such a way that the index notch in the barrel nut is exactly centered on the gas tube hole in the upper receiver. If this is not done, the gas tube will bind in the hole, causing it to be misaligned with the key in the bolt carrier, which in turn increases the drag on the bolt carrier and leads to short stroking.

Once these two features are correct, the novel retro-fit gas system installs in place of the original short gas tube with no alterations to the gun. The original short gas tube has its front end removed from the rear end of the front sight assembly that is directly connected to the port in the gun barrel. The rear end of the original short gas tube is removed from its mating connection in the bolt carrier mechanism.

The retro-fit gas system has a first gas tube that passes longitudinally through a junction block. A second gas tube has its front end removably inserted into a longitudinal bore hole in the rear wall of the junction block. A cross passage bore hole in the junction block aligns with port apertures in the respective first and second gas tubes therein. The retro-fit gas system is installed by inserting the front end of the first gas tube where the front end of the original short gas tube had been removed. This tube installs with the same 5/64 inch pin as the original short tube did into the front sight assembly. After the front gas tube is pinned into place, the second gas tube has its rear end inserted into the receptacle of the original short gas tube. The front end of the second gas tube is then rotated into alignment with the upper bore hole in the rear wall of the junction block and slid forward until it stops. Once the 5/64 inch pin hole in the second gas tube is visible through the lower access hole in the junction block, a mounting pin can be driven into the aligned bore holes until it is centered evenly in the block. This completes the installation of the retro-fit gas system and the upper hand guard is then replaced to cover the retro-fit gas system.

DESCRIPTION OF THE PREFERRED EMBODIMENT

Figure 1:
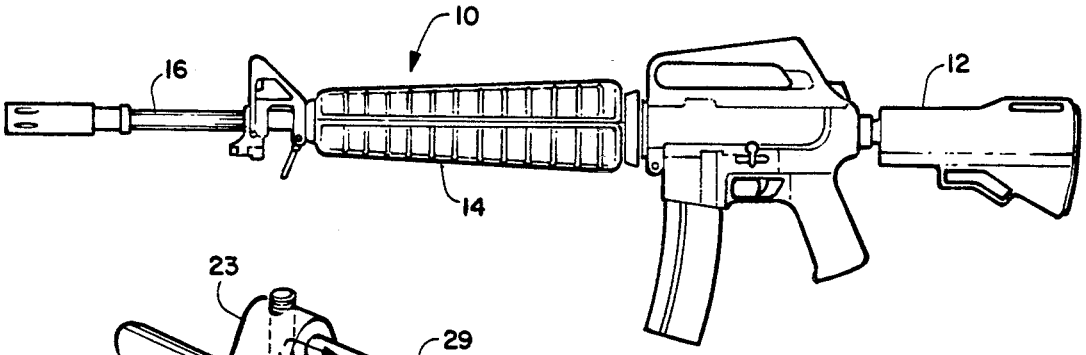
FIG. 1 is a side view of a typical Colt M16 carbine.
Figure 2:
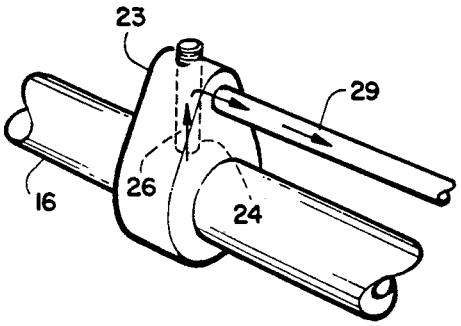
FIG. 2 illustrates the conventional pick-off device for detecting the build-up of pressure in a barrel of a typical assault rifle as illustrated in FIG. 1.
Figure 2A:
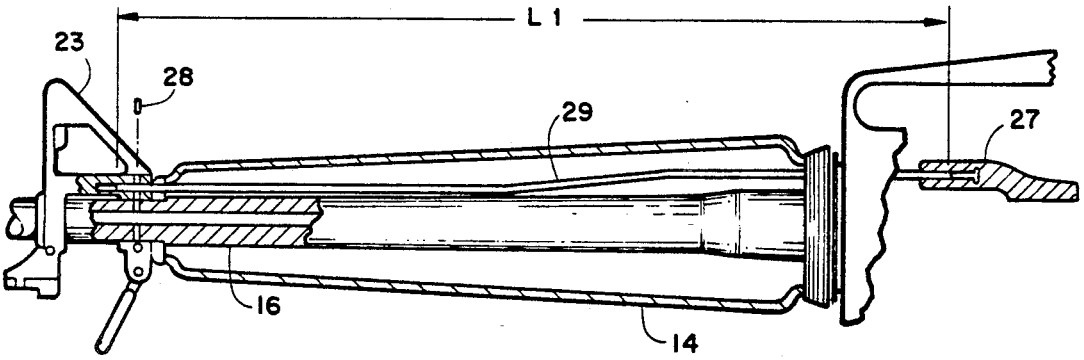
FIG. 2A is a side elevation view of the original short gas tube that is being replaced.

The novel retro-fit gas system will now be described by referring to the drawing. FIG. 1 shows a side view of a conventional gas operated automatic carbine 10 commonly known as the M16. Carbine 10 comprises the basic operating parts such as its stock 12, handguards 14 and barrel 16. In FIG. 2, a gas pick-off device 23 having an internal port 24 is located over a port 26 located on the barrel 16. As soon as the projectile has passed the gas port 26 the high pressure gases behind the projectile start to flow into the opening 24 building up pressure that is fed by means of the original short gas tube 29 and then on to the bolt carrier mechanism associated with the rifle 10. The exisitng original short gas tube 29 for the M16 carbine is illustrated in FIG. 2A and it has a length L1. Its rear end seats in bolt carrier key 27 and its front end is secured to gas pick-off device 23 by cross pin 28.

Figure 3:
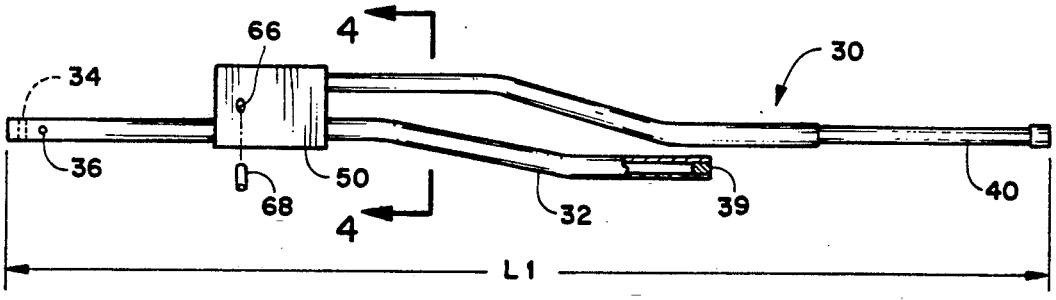
FIG. 3 is a side elevation view of the novel retro-fit gas system in its assembled state.
Figure 4:
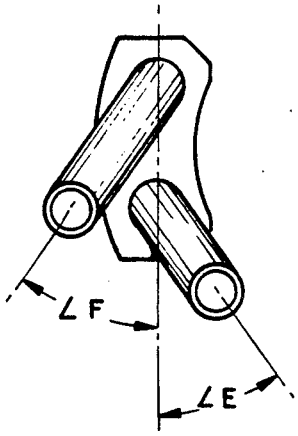
FIG. 4 is a cross-sectional view taken along lines 4–4 of FIG. 3.
Figure 5:
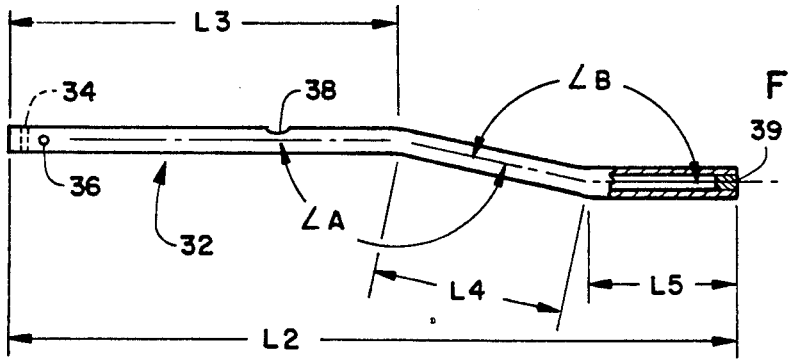
FIG. 5 is a side elevation view of the first gas tube.
Figure 6:
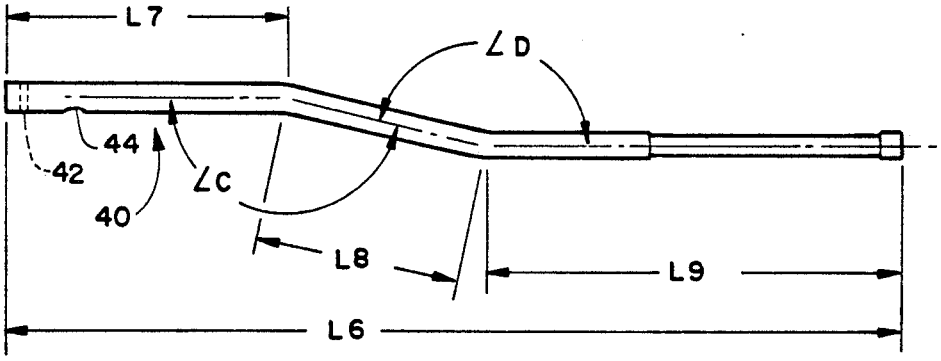
FIG. 6 is a side elevation view of the second gas tube.

The retro-fit gas system is generally designated numeral 30 and it is illustrated in its assembled form in FIG. 3. The different components of retro-fit gas system 30 are illustrated individually in FIGS. 5–8.

The first gas tube 32 has a length L2 that is in the range of 6.188 to 6.250 inches. Front portion L3 has a length of 3.312 inches. Intermediate portion L4 has a length of 1.65 inches. The longitudinal axes of front portion L3 and rear portion L5 are offset 0.350 inches. The pinhole 34 is formed adjacent the front end of front portion L3 and shortly behind that is formed a port 36 that accesses the interior of the tube. Further down the length of front portion L3 is the port 38 that is also in communication with the interior of the tube. The rear end of portion L5 has a plug 39 closing it. Front portion L3 makes an angle A which is 167 degrees with respect to intermediate portion L4. Intermediate portion L4 makes an agle B that is equal to 167 degrees with respect to rear portion L5.

The second gas tube is designated numeral 40. Its length L6 is 7.700 inches. It has a front portion L7 that is 2.400 inches long, an intermediate portion L8 that is 1.625 inches long, and a rear portion L9. The longitudinal axes of front portion L7 and rear portion L9 are parallel and laterally offset each other 0.500 inches. Front portion L7 makes an angle C equal to a 160 degrees with intermediate portion L8. Intermediate portion L8 makes an angle B equal to 160 degrees with respect to rear portion L9. The front end of front portion L7 is solid and it has a pin hole 42 extending transversely therethrough. Port 44 is in communication with the interior of the second gas tube.

Figure 7:
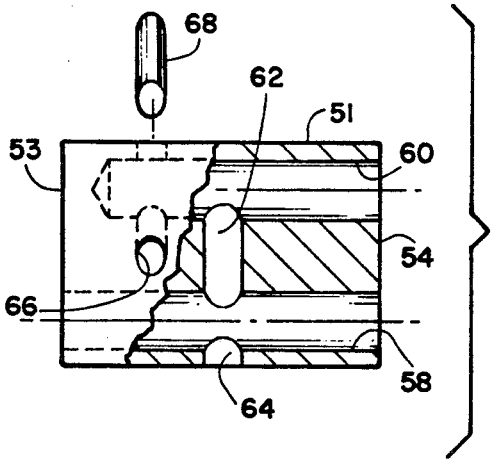
FIG. 7 is a side elevation view of the junction block.
Figure 8:
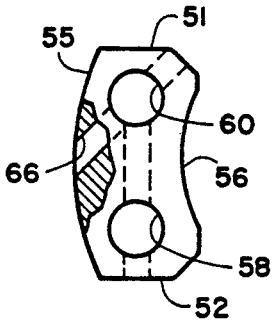
FIG. 8 is a rear elevation view of the junction block.

Junction block 50 is illustrated in FIGS. 7 and 8. It is a solid block of material having a top wall 51, a bottom wall 52, a front end 53, the rear end 54, a left side wall 55 and a right side wall 56. A lower bore hole 58 extends longitudinally through the entire length of junction block 53. An upper bore hole 60 is formed in rear end 54. A cross passage bore hole 62 is in communication with lower bore 58 and upper bore hole 60. A plug 64 fills the lower end of cross passage bore hole 62. The pin bore hole 66 removably receives the pin 68 that passes through pin hole 42 of second gas tube 40. This aligns port 44 with cross passage bore hole 62. Port hole 38 of first gas tube 32 also aligns with cross passage bore hole 62. Left side wall 55 has a convex vertical contour. Right side wall 56 has a partial concave vertical contour, in order to fit between the barrel and the upper handguard without interference upon final installation.

What is claimed is:

1. A retro-fit gas system for controlling the firing rate of the Colt M16 automatic carbine that involves removing the existing short gas tube that has a longitiudinal axis extending from its front end to its rear end and that has a length L1 and replacing it with a gas tube assembly comprising:

a first gas tube having a front end and a rear end and having a predetermined length L2, said first gas tube has a front portion L3, an intemediate portion L4 and a rear portion L5, intermediate portion L4 intersects front portion L3 at an angle A and rear portion L5 at an angle B, the longitudinal axes of L3 and L5 are parallel to each other and laterally offset, the front and rear ends of said first gas tube are closed, a first radial port is formed adjacent the front end of said first tube for communicating with existing front sight gas port in said Colt M16 coming from the front of its barrel, a second radial port is formed in said front portion intermediate its length;

a junction block having a predetermined height, width and length, said junction block having top and bottom walls, front and rear ends, and left and right side walls; an upper bore hole is formed in said rear end and it extends horizontally a predetermined distance, a lower bore hole extends horizontally from said front end to said rear end, a vertically extending cross passage bore hole connnects said upper and lower bore hole intermediate their length;

said first gas tube having its front portion L3 inserted through the lower bore hole of said junction block and being permanently attached thereto; and a second gas tube having a front end and a rear end and having a predetermined length L6, said second gas tube has a front portion L7, an intermediate portion L8 and a rear portion L9, intermediate portion L8 intersects front portion L7 at an angle C and rear portion L9 at an angle D, the longtiudinal axes of L7 and L9 are parallel to each other and laterally off-set, the front end of said second gas tube is closed, a transversely extending pin hole is formed adjacent the front end of said second tube for receiving a securing pin, a first radial port is formed adjacent the front end of said second tube for communication with the cross passage bore hole of said junction block, the front end of second gas tube is removably received in the upper bore hole of said junction block.

2. The gas tube assembly as recited in claim 1 comprising means for securing the front end of said second gas tube in said junction block.

3. The gas tube assembly as recited in claim 1 wherein angle A is 167 degrees and angle B is 167 degrees on said first gas tube.

4. The gas tube assembly as recited in claim 1 wherein L2 is in the range of 6.188 to 6.250 inches in length.

5. The gas tube assembly as recited in claim 1 wherein angle C and angle D are 160 degrees on said second gas tube.

6. The gas tube assembly as recited in claim 1 wherein the longitudinal axes L3 and L5 are laterally offset from each other 0.350 inches.

7. The gas tube assembly as recited in claim 1 wherein the longitudinal axes of L7 and L9 are laterally offset form each other 0.500 inches.

8. The gas tube assembly as recited in claim 1 wherein the left side wall of said junction block has a convex curvature from its top wall to its bottom wall.

9. The gas tube assembly as recited in claim 8 wherein the right side wall of said junction block has a vertical concave curvature.

* * * * *